United States Patent [19]

Marquis

[11] 4,028,742

[45] June 14, 1977

[54] MOTORCYCLE SAFETY BELT

[76] Inventor: Wilfred Marquis, 132 Baxter St., Pawtucket, R.I. 02861

[22] Filed: July 19, 1976

[21] Appl. No.: 706,189

[52] U.S. Cl. ..... 2/305; 2/300; 2/311; 2/93

[51] Int. Cl.[2] ..... A41F 19/00

[58] Field of Search ..... 2/300, 311, 312, 338, 2/93, 94, 305, 321–325; 182/4, 3; 297/384, 385, 389

[56] References Cited

UNITED STATES PATENTS

| | | | |
|---|---|---|---|
| 3,004,519 | 10/1961 | Weissman | 182/4 X |
| 3,487,474 | 1/1970 | De Meo | 2/311 |
| 3,533,107 | 10/1970 | Raneri et al. | 2/93 |
| 3,562,812 | 2/1971 | Greggains | 2/94 |
| 3,564,616 | 2/1971 | Battaglia | 2/300 X |

*Primary Examiner*—G. V. Larkin

[57] ABSTRACT

A safety belt device for drivers of high speed unenclosed vehicles that includes upper and lower belt bands with coupling means associated therewith and connecting means for joining the respective belt bands together. Loop means in the form of shoulder straps further support the device by extending over the shoulders of the wearer and around the lower belt band. A pair of resiliently mounted spaced apart handles are provided that return to their original position when not in use and thereby remain fixed.

10 Claims, 3 Drawing Figures

MOTORCYCLE SAFETY BELT

BACKGROUND OF THE INVENTION

This invention relates to improvements in safety devices particularly for use by passengers riding in tandem on motorcycles, toboggans, snowmobiles and other high speed unenclosed vehicles of this general type.

With the ever-increasing use of motorcycles having tandem seats, snowmobiles and certain sleds, there is a need for a simplified, versatile stabilizing or balancing means for the rear rider; in short, some ready means for him to grip with his hands approximately waist-high or elbow-high. A second set of handle bars is not always feasible or safe or even practical without altering the conventional structure of the vehicle and increasing its cost.

It has been well established that a safety device or belt worn by the driver of the vehicle and easily grasped by the tandem rider would be most beneficial in avoiding accidents that from time to time occur to the rear rider.

OBJECTS OF THE INVENTION

An object of the present invention is to provide a safety device which encircles the waistline and chestline of the driver of a vehicle and further includes handles easily grasped by the rear rider.

Another object of the present invention is to provide a safety device that by its double buckle system provides further security in case one of the buckles should open or be torn loose.

Another object of the present invention is to provide a safety device worn by the driver in which the handles thereof return to their normal inoperative position when released by the tandem rider.

Other objects and advantages of the present invention will become apparent as the disclosure proceeds.

SUMMARY OF THE INVENTION

A novel safety belt device is disclosed that can be used with a variety of high speed unenclosed vehicles in which the tandem driver needs support. To provide greater safety a pair of spaced apart belt bands are provided to encircle the wearer, the lower belt is at waist level and the upper belt at chest level.

A pair of shoulder straps extend from the belts with loop means at the free ends thereof. Each shoulder strap extends over the shoulder of the user and the lower belt slips within the loops so further harness the safety belt to the user. A pair of resiliently mounted spaced apart handles are provided that return to their original position when not in use. In this manner the handles do not flap around when the rear seat is vacant.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION OF THE PREFERRED EMBODIMENT

Figure 1:
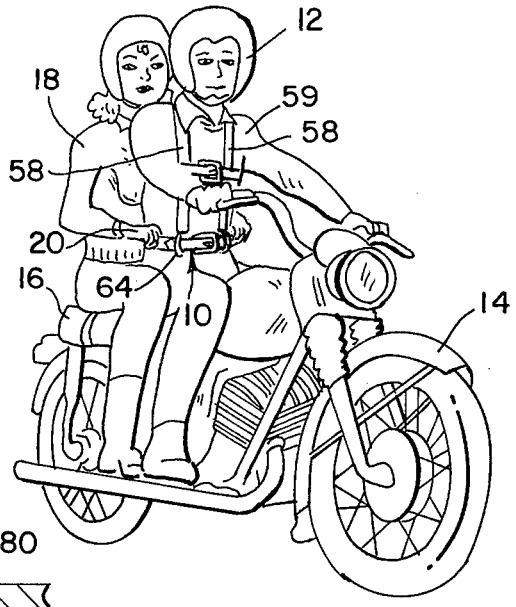
FIG. 1 is a view of a driver and a passenger riding in tandem on a motorcycle with the passenger's hands shown grasping the handles.

Referring to the drawings in detail, and particularly FIG. 1, there is shown the safety belt 10 in accordance with the present invention worn by a driver 12 on a motorcycle 14 having a suitable seat 16 with a passenger 18 utilizing the passenger's hands 20 to maintain the seated position and prevent slippage from the seat 16.

Figure 2:
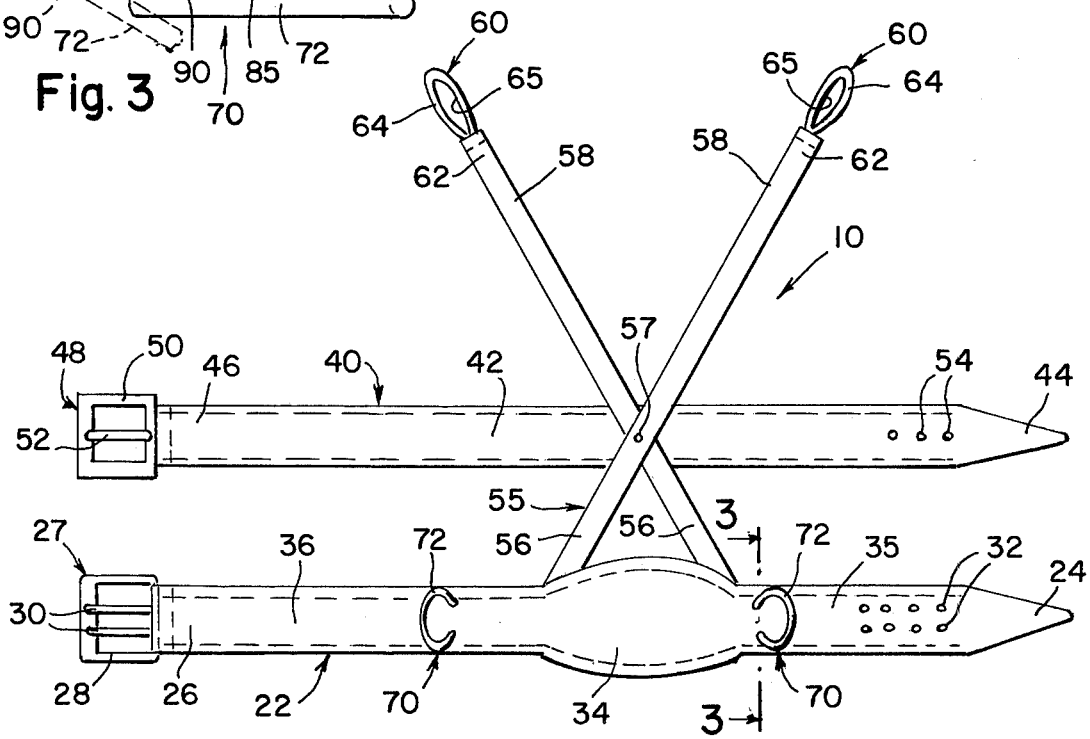
FIG. 2 is a front plan view of the safety device in accordance with the present invention.

The safety belt 10 is adapted to be worn by the driver 12 and as seen in FIG. 2, and includes a lower elongated belt band 22 having or terminating in a tapered front end 24 with spaced apart rear end 26 with lower coupling means 27. The lower coupling means 27 includes a buckle 28 secured thereto and having prong 30 extending therefrom in a conventional manner. The belt band 22 may include a plurality of spaced apart sets of holes or apertures 32 for receipt therein of the prongs 30 when the belt is in surrounding relationship to the wearer 12. The lower belt band 22 acts as a waist belt and may have a centrally disposed enlarged section 34 that acts as a back support for the wearer 12. The belt band 22 may have a front section 35 integrally formed with the enlarged section 34 and terminating at the tapered front end 24. A rear portion 36 may be integrally formed with the enlarged portion 34 and terminating at the other end 26.

An upper elongated belt band 40 is provided and includes a belt body 42 terminating at one end in a tapered portion 44 and at its opposite end 46 is connected to upper coupling means 48 that may include a belt buckle 50 having a pivotally mounted prong 52 with respect to the belt buckle 50 and a plurality of openings 54 adjacent the free end 44. The lower elongated belt band 22 and the upper elongated belt band 40 may each be made of a flexible material having little tendency to stretch during usage such as leather or plastic.

Connecting means 55 is provided for joining the lower belt band 22 to the upper belt band 40 and as illustrated in FIG. 2 may include a pair of connecting straps 56 that may be stitched or otherwise secured to the lower belt band 22 and secured to the upper belt band 40 as by a fastener 57 that may be in the form of a rivet.

A pair of shoulder straps 58 are provided and may be integrally formed with the connecting straps 56. The shoulder straps 58 are of a length to extend over and beyond the shoulder 59 of the user of the safety belt 10 so as to extend across the back of the wearer and onto the front chest portion.

Loop means 60 extends from the free end 62 of each of the shoulder straps 58 and may include a loop member 64 having an inner opening 65 adapted to receive the belt 22. In this manner the lower belt portion 35 will extend through one loop member 64 and the other lower belt portion 36 will extend through the other loop member 64 as illustrated in FIG. 1. In this manner a positive securement is obtained between the safety belt 10 and the wearer 12.

Figure 3:
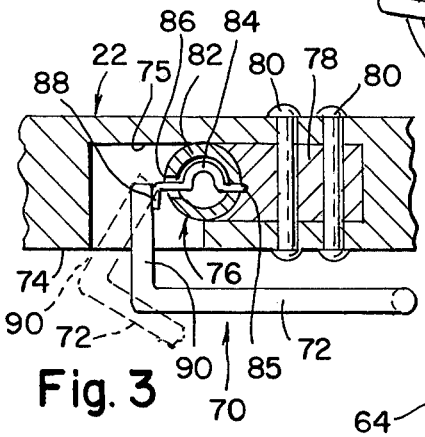
FIG. 3 is an enlarged fragmentary view of the mounting relationship of the handle taken along lines 3—3 of FIG. 2.

Handle means 70 is provided and includes a pair of spaced apart handle members 72 that may be grasped by a passenger 18 riding in tandem behind the driver 12 wearing the safety belt 10. As illustrated in FIG. 3 and the handle 72 is resiliently pivotally mounted such that it returns to its original position against or adjacent the front surface 74 of each lower belt portion. The lower belt portion 22 includes a cavity 75 with hinge means 76 positioned therein. The hinge means 76 includes a hinge plate 78 mounted by rivets 80 in fixed position to the lower belt portion 22. A housing 82 is connected to the hinge plate 78 and has a leaf spring 84 mounted within the housing 82 and in fixed relation at one end 85 thereof and extending outwardly from the housing 82 through an opening 86. The free end 88 of the leaf spring 84 is rigidly coupled to the arm 90 of the handle 72. In this manner the outwardly directed force applied by the user 18 is counterbalanced by the leaf spring 84 such that when released the handles 72 return to their original position with respect to the lower belt band 22. In this manner the handle 72 do not hang loose when the rear seat is vacant. The user may grasp the handles 72 to overcome the spring force to pull the handles 72 away from the lower belt 22 during use of the safety belt 10.

Although an illustrative embodiment of the invention has been described in detail herein with reference to the accompanying drawings, it is to be understood that the invention is not limited to the precise embodiment, and that various changes and modifications may be effected therein without departing from the scope or spirit of the invention.

I claim:

1. A safety belt adapted to be worn by a driver of a vehicle, said belt comprising:

a. a lower elongated belt band terminating in ends, b. lower coupling means releasably interconnecting the ends of said lower belt band, c. an upper elongated belt band terminating in ends, d. upper coupling means releasably interconnecting the ends of said upper belt band, e. connecting means joining said lower belt band to said upper belt band in spaced relationship to each other, f. a pair of shoulder straps extending from said upper belt band, g. loop means extending from the free end of each of said shoulder straps, said straps adapted to extend over the shoulder of the wearer of the safety belt with said lower belt band extending through said loop means to firmly secure the safety belt around the wearer, and h. handle means to be grasped by a passenger riding in tandem behind the driver wearing the safety belt, said handle means including a pair of spaced apart handles resiliently pivotally connected to said lower belt band such that said handles return to their original position with respect to said lower belt band when said handles are released.

2. A safety belt as defined in claim 1, wherein said handle means includes:

a. a pair of springs, each one of said springs mounted at one end thereof in fixed relationship to said lower belt band, and b. each one of said handles being coupled to the opposite end of each one of said springs such that each one of said handles is normally retained adjacent said lower belt band.

3. A safety belt as defined in claim 2, and further including housing means in surrounding relation to each said spring with said housing means secured to said lower elongated belt band.

4. A safety belt as defined in claim 1, wherein said connecting means includes a pair of spaced apart connecting straps secured at one end to said lower belt band and at said opposite end to said upper belt band.

5. A safety belt as defined in claim 4, wherein said shoulder straps are integrally formed with said connecting straps.

6. A safety belt as defined in claim 1, wherein said lower belt band has an enlarged centrally disposed portion to act as a back support for the wearer of the safety belt.

7. A safety belt as defined in claim 1:

a. wherein said lower coupling means includes a buckle at one end of said lower belt and a plurality of apertures at the opposite end thereof for receiving the prongs of said buckle, and b. wherein said upper coupling means includes a buckle at one end of said upper belt and a plurality of apertures at the opposite end thereof for receiving the prongs of said buckle.

8. A safety belt as defined in claim 1, wherein said lower and upper belt bands are made of flexible material having little tendency to stretch.

9. A safety belt as defined in claim 1, a. wherein said handle means includes:

i. housing means secured to said lower elongated belt band, ii. a pair of springs, each one of said springs mounted relative to said housing means in spaced apart relationship to each other and fixed at one end relative to said housing means, iii. each one of said handles being coupled to the opposite end of each one of said springs such that each said handle is normally retained adjacent said lower belt band, b. wherein said connecting means includes a pair of spaced apart connecting straps secured at one end of said lower belt band and at said opposite end to said upper belt band, and c. wherein said shoulder straps are integrally formed with said connecting straps.

10. A safety belt as defined in claim 9:

a. wherein said lower coupling means includes a buckle at one end of said lower belt and a plurality of apertures at the opposite end thereof for receiving the prongs of said buckle, and b. wherein said upper coupling means includes a buckle at one end of said upper belt and a plurality of apertures at the opposite end thereof for receiving the prongs of said buckle.

* * * * *